US006938704B2

(12) United States Patent
Berger et al.

(10) Patent No.: US 6,938,704 B2
(45) Date of Patent: Sep. 6, 2005

(54) PNEUMATIC PERCUSSIVE TOOL WITH A MOVEMENT FREQUENCY CONTROLLED IDLING POSITION

(75) Inventors: Rudolf Berger, Grünwald (DE); Mirko Lysek, München (DE); Wolfgang Schmid, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/467,289

(22) PCT Filed: Mar. 11, 2002

(86) PCT No.: PCT/EP02/02657

§ 371 (c)(1),
(2), (4) Date: Aug. 5, 2003

(87) PCT Pub. No.: WO02/072315

PCT Pub. Date: Sep. 19, 2002

(65) Prior Publication Data

US 2004/0065455 A1 Apr. 8, 2004

(30) Foreign Application Priority Data

Mar. 12, 2001 (DE) ..... 101 11 717

(51) Int. Cl.[7] ..... B25D 17/00

(52) U.S. Cl. ..... 173/201; 173/109; 173/117; 173/118; 173/200; 173/202; 173/209

(58) Field of Search ..... 173/14, 109, 116, 173/117, 201, 202, 209, 118, 200

(56) References Cited

U.S. PATENT DOCUMENTS

| | | | | |
|---|---|---|---|---|
| 3,161,242 A | * | 12/1964 | Etzkorn et al. | 173/109 |
| 3,570,608 A | * | 3/1971 | Erma | 173/201 |
| 3,835,935 A | * | 9/1974 | Sides et al. | 173/14 |
| 3,913,633 A | * | 10/1975 | Hiller | 141/45 |
| 4,201,269 A | * | 5/1980 | Ross | 173/1 |
| 4,222,443 A | | 9/1980 | Chromy | |
| 4,567,951 A | * | 2/1986 | Fehrle et al. | 173/201 |
| 4,683,960 A | * | 8/1987 | Kostylev et al. | 173/91 |
| 4,759,260 A | * | 7/1988 | Lew | 91/394 |
| 4,828,046 A | * | 5/1989 | Pyatov | 173/14 |
| 6,043,623 A | | 3/2000 | McCary | |

FOREIGN PATENT DOCUMENTS

| | | |
|---|---|---|
| EP | 0 775 556 | 5/1997 |
| GB | 1113297 | 8/1968 |
| WO | WO 88/06508 | 9/1988 |

* cited by examiner

*Primary Examiner*—Louis K. Huynh
*Assistant Examiner*—Nathaniel Chukwurah
(74) *Attorney, Agent, or Firm*—Boyle Fredrickson Newholm Stein & Gratz S.C.

(57) ABSTRACT

The invention relates to a pneumatic percussive tool for a paving breaker and/or a hammer drill comprising a drive piston which is displaceable both backwards and forwards by a crankshaft and arranged in a percussion piston which is displaceable both backwards and forwards. A hollow chamber is connected to a compensating chamber by an idling air channel and embodied between the drive piston and the percussion piston in order to receive a pneumatic spring. A valve is arranged in the idling air channel, the opening and closing position thereof depending on the rotational speed of the crankshaft. If the rotational speed of the crankshaft falls below a predetermined value, the valve opens the connection between the hollow chamber and the compensating chamber so that a pneumatic spring can no longer be to embodied in the hollow chamber and the pneumatic percussion tool is placed in a idling position.

20 Claims, 5 Drawing Sheets

PNEUMATIC PERCUSSIVE TOOL WITH A MOVEMENT FREQUENCY CONTROLLED IDLING POSITION

BACKGROUND OF THE INVENTION

1. Field of the Invention

The present invention relates to a pneumatic spring hammer mechanism or pneumatic percussive tool for a percussive hammer or drill hammer, according to the preamble of patent claim 1.

2. Description of the Related Art

Pneumatic spring hammer mechanisms have long been known in various specific embodiments in which a drive piston is moved back and forth by a crankshaft. In front of the drive piston there is situated a percussion piston that can likewise be moved back and forth, so that between the drive piston and the percussion piston there is formed a hollow space that accommodates an air spring. This air spring, which acts as an air cushion, transmits the movement of the driven drive piston to the percussion piston, which thus follows the movement of the drive piston with a chronological delay. Finally, the percussion piston impacts a shaft of a tool, or of an intermediately connected die, and transfers its impact energy to the tool.

Pneumatic spring hammer mechanisms of this sort have proven effective in practice, both in hammers having electromotor drives and in hammers that operate using an internal-combustion engine.

In particular, the internal-combustion-engine-operated hammers have a centrifugal force coupling between a motor shaft and the crankshaft that decouples the hammer mechanism drive when the internal-combustion engine is rotating at idling speed. In this way, on the one hand an unproblematic idling operation of the engine is ensured, and on the other hand an easier starting of the engine is enabled. Such a centrifugal force coupling is technically costly, requires constructive space, and finally results in a relatively expensive, heavy hammer that is subject to wear.

OBJECTS AND SUMMARY OF THE INVENTION

The underlying object of the invention is to provide a pneumatic spring hammer mechanism in which the advantages of the transmission and interruption of torque via the centrifugal force coupling are retained, without having to accept the named disadvantages.

According to the present invention, this object is achieved by a pneumatic spring hammer mechanism according to patent claim 1. Advantageous developments of the present invention are defined in the dependent claims.

In the pneumatic spring hammer mechanism according to the present invention, an idling air channel is provided via which the hollow space, situated between the drive piston and the percussion piston, that accommodates an air spring during percussive operation can be connected with a compensating chamber. The compensating chamber can for example be the crank chamber, in which the crankshaft rotates in order to drive the drive piston. Alternatively, the compensating chamber can also be the area surrounding the pneumatic spring hammer mechanism; if this is the case it should be ensured that dirt, dust, moisture, etc., cannot penetrate into the hollow space via the compensating chamber and the idling air channel.

In addition, according to the present invention there is situated in the idling air channel a valve whose open and closed positions are dependent on the frequency of movement of the drive piston. In this way, it is achieved according to the present invention that the switching off of the pneumatic spring hammer mechanism, i.e., the transition from percussive operation to idling operation, takes place not in the known manner (i.e., mechanically via a centrifugal coupling), but rather via a movement-frequency-controlled interruption of the suction action of the hammer mechanism.

In an advantageous specific embodiment of the present invention, the valve can be opened if the frequency of movement of the drive piston falls below a predetermined value, so that via the idling air channel a communicating connection arises between the hollow space and the compensating chamber. In the idling operation resulting therefrom, an air spring can no longer build up in the hollow space even if the drive piston continues to execute an oscillating motion; the result is that the percussion piston, which during percussive operation is driven by the air spring, now can be neither driven forward nor suctioned backward. A reliable interruption of the percussive operation is thus ensured.

The frequency of movement of the drive piston is a parameter that, as far as the present invention is concerned, is equivalent to a series of further parameters. These include, in particular, the rotational speed of a crankshaft or wobble shaft that drives the drive piston, as well as the rotational speed of the drive motor that drives a drive mechanism. The rotational speed of the drive motor can in turn be determined for example through the ignition frequency, i.e., the ignition if the drive motor is an internal-combustion engine. In the case of an electric motor, the rotational speed can be determined on the basis of the power consumption. Because the drive motor is always connected with the drive piston via the drive mechanism, the movement behavior of one of these elements can be used to determine the movement behavior of the other elements as well. Due to the mostly positively-locked energy transmission from the drive motor to the drive piston, there is a linear relation between the individual movement parameters.

The same holds in corresponding fashion for other drive designs. If the drive piston is driven e.g. via a linear motor, this offers the expert further possibilities for determining the frequency of movement of the drive piston on the basis of various operating parameters. Correspondingly, a sensor device for acquiring the frequency of movement of the drive piston is to be formed in such a way that it can also acquire a movement parameter that cannot be allocated directly to the drive piston. Accordingly, the sensor device is for example capable of determining the frequency of movement of the drive piston by acquiring the rotational speed of the crankshaft that drives the drive piston.

In a preferred specific embodiment, the valve can thus be opened and closed dependent on a signal of a rotational speed sensor that acquires the rotational speed of the crankshaft.

Here, a movable centrifugal weight situated on the crankshaft is also to be seen as a rotational speed sensor in a broader sense, via which the valve can be controlled, whereby the valve can be opened and closed dependent on a position of the centrifugal weight. In another specific embodiment of the present invention, the rotational speed sensor is used for the electrical or electronic acquisition of the rotational speed of the crankshaft. Its signal is to be supplied to the valve, e.g., an electromagnetic valve, in a suitable fashion.

In a particularly advantageous specific embodiment of the present invention, an additional idling device is provided with which, independent of the frequency of movement of the drive piston or of the speed of rotation of the crankshaft, the hollow space can be brought into communicating connection with the compensating chamber, if the percussion piston moves into a forward axial position that acts as an idling position, through the sliding of a tool impacted by this piston out of a housing of the percussive and/or drill hammer. In this way, it is possible for the pneumatic spring hammer mechanism to move into an idling state independently of the above-described movement-frequency-dependent or rotational-speed dependent idling operation. In this pneumatic spring hammer mechanism, there are therefore two possibilities for achieving idling operation: on the one hand, the idling operation is set automatically if the frequency of movement of the drive piston or the rotational speed of the crankshaft falls below the predetermined value. On the other hand, independently thereof, the pneumatic spring hammer mechanism also enters idling operation if the operator lifts the tool off the stone that is to be processed, and the tool can correspondingly slide out of the housing of the hammer to some extent.

The pneumatic spring hammer mechanism according to the present invention can be realized for various design principles, e.g. in what is called a hollow-hammer hammer mechanism, in which the drive piston moves in a hollow region of the percussion piston, or in a hollow piston hammer mechanism, in which the drive piston has a hollow area in which the percussion piston is accommodated so as to be able to move axially, or in a tube hammer mechanism, in which the percussion piston and the drive piston have essentially the same diameter, and are guided in common in a hammer mechanism tube.

BRIEF DESCRIPTION OF THE DRAWINGS

This and other advantages and features of the present invention are explained in more detail below on the basis of an exemplary embodiment, with the aid of the accompanying Figures.

DETAILED DESCRIPTION OF THE PREFERRED EMBODIMENT

Figure 1:
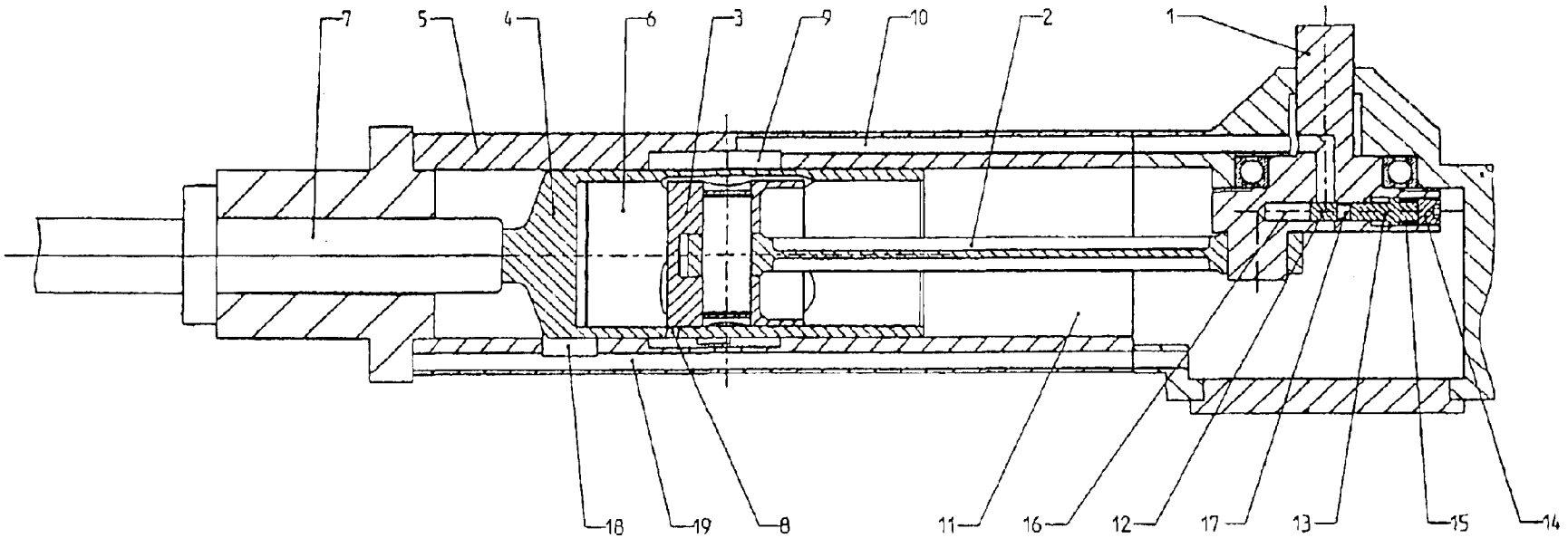
FIG. 1 shows a schematic section of a pneumatic spring hammer mechanism according to the present invention, realized as a "hollow-hammer hammer mechanism," in percussive operation.

FIG. 1 shows a section through a pneumatic spring hammer mechanism according to the present invention, in percussive operation.

Via a connecting rod 2, a crankshaft 1 drives a drive piston 3 back and forth axially. Drive piston 3 is housed in a percussion piston 4, which in turn can be moved back and forth axially inside a tube-shaped hammer mechanism housing 5.

Such a pneumatic spring hammer mechanism is also designated a hollow-hammer hammer mechanism, and is known.

In percussive operation, drive piston 3 moves back and forth inside percussion piston 4, which causes an air spring to build up in a hollow space 6 formed between drive piston 3 and percussion piston 4. When drive piston 3 moves forward (to the left in FIG. 1), the air in hollow space 6 is compressed. The energy of the air compressed as an air spring is emitted to percussion piston 4 and likewise drives it forward, against a shaft 7 (shown schematically) of a chiseling tool. Instead of shaft 7, a rivet header, which is not depicted but is known, can also be impacted by percussion piston 4.

After the impact has taken place, drive piston 3 has already begun its travel back, due to the rotational movement of crankshaft 1, and suctions percussion piston 4, which is rebounding from shaft 7, further backward, until drive piston 3 finally goes into forward motion again, and, through the buildup of a pressure in the air spring, the percussion cycle begins again.

Via an idling opening 8, an annular groove 9 formed on the inside of hammer mechanism housing 5, and a channel 10, hollow space 6 is connected with a crank chamber 11 that acts as a compensating chamber. Crank chamber 11 essentially circumscribes the space in which crankshaft 1 can move with connecting rod 2 and drive piston 3.

Idling operation opening 8, annular groove 9, and channel 10 together form an idling air channel.

At the crank-chamber end of channel 10, there is situated a valve 12 that is coupled in one piece with a centrifugal weight 13. Together with centrifugal weight 13, valve 12 can be moved radially, with reference to crankshaft 1, in a guide 16, against the action of a spring 15 that is supported against a stop 14.

FIG. 1 shows the percussive operation of the pneumatic spring hammer mechanism, in which crankshaft 1 is driven with the operating rotational speed of an internal-combustion engine (not shown), or, if a transmission is situated between the internal-combustion engine and crankshaft 1, with a rotational speed corresponding to the operating rotational speed. Due to the centrifugal force acting on centrifugal weight 13 and, if warranted, also on valve 12, valve 12, together with centrifugal weight 13, is held in guide 16 in the position shown in FIG. 1, radially outward against the action of spring 15. Channel 10 is closed by valve 12.

Figure 2:
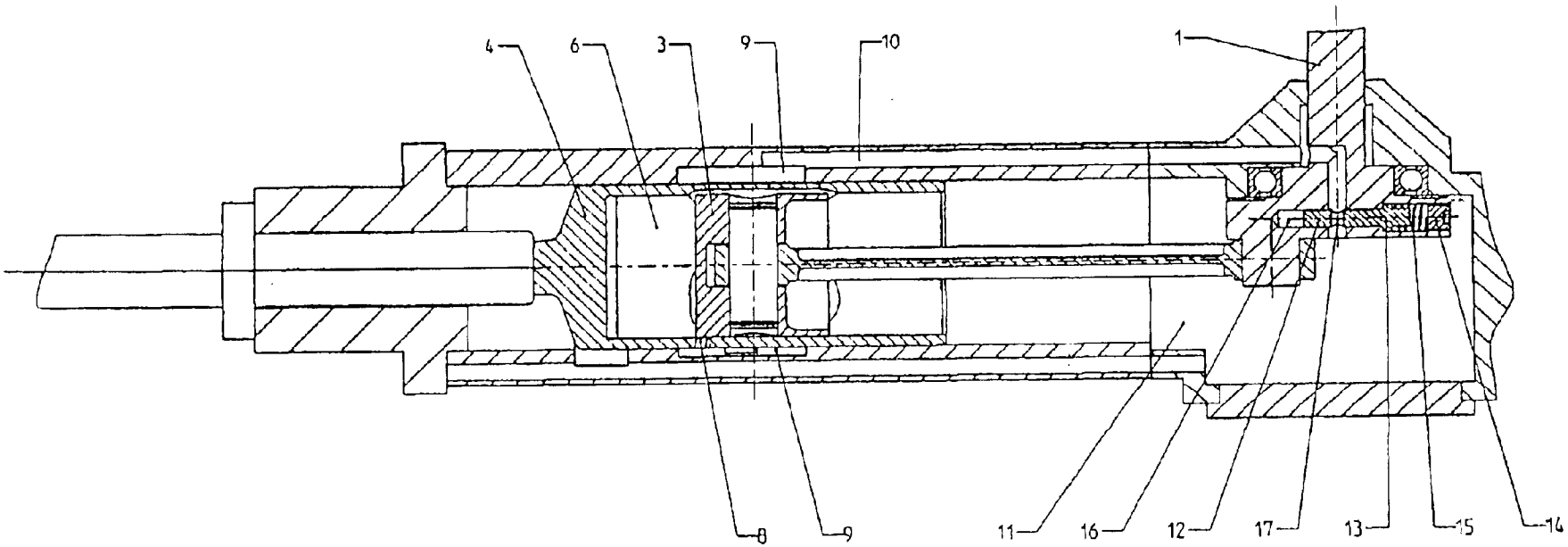
FIG. 2 shows the pneumatic spring hammer mechanism of FIG. 1, in idling operation.

FIG. 2 shows the same pneumatic spring hammer mechanism as is shown in FIG. 1, but in idling operation.

Idling operation is a state in which the internal-combustion engine (not shown) rotates not at the operating rotational speed, but with a lower rotational speed, in particular the idling rotational speed.

Due to the reduced rotational speed of crankshaft 1, spring 15 is now strong enough to press centrifugal weight 13 with valve 12 radially inward into guide 16. In this way, valve 12 moves into an open position in which an opening 17 is aligned with channel 10, and opens this channel.

In this way, there arises a communicating connection between hollow space 6 and crankshaft chamber 11, via idling opening 8, annular groove 9, and channel 10. As a consequence, no air pressure, and, correspondingly, no air spring, can build up in idling hollow space 6. Although drive piston 3 continues to move back and forth in percussion piston 4, percussion piston 4 remains in its idling position, because pneumatic forces no longer act on it due to the lack of changes in air pressure. The pneumatic spring hammer mechanism is thus reliably in idling operation.

The action of spring 15 is overcome only when the rotational speed of the motor, and therewith the rotational speed of crankshaft 1, is increased, so that centrifugal weight 13, with valve 12, slides radially outward and closes opening 17. In this way, hollow space 6 is separated from crank chamber 11, and an air spring can again build up in hollow space 6.

Strictly speaking, centrifugal weight 13 also acts as a rotational speed sensor, because it detects a change in rotational speed through the shifting of its radial position. The shifting of the radial position is in turn to be evaluated as a signal dependent on which valve 12, which is connected in one piece with centrifugal weight 13, is opened or closed.

In the above-described specific embodiment, the rotational speed of crankshaft 1 is the criterion according to which the frequency of movement of drive piston 3 is determined. However, instead of the rotational speed of the crankshaft, the rotational speed of the drive motor (not shown) could also be acquired through centrifugal weight 13.

Instead of crankshaft 1, it is possible to bring drive piston 3 into oscillating back-and-forth movement using other drive mechanisms, such as for example a wobble plate.

It should additionally be mentioned that an additional idling device is formed by idling opening 8, an opening 18, and a channel 19. Via idling opening 8, opening 18, and a channel 19, a further communicating connection between hollow space 6 and crank chamber 11 can be produced independently of the above-described connection via annular groove 9 and channel 10. The manner of functioning of the additional idling device is explained below on the basis of FIG. 3.

Figure 3:
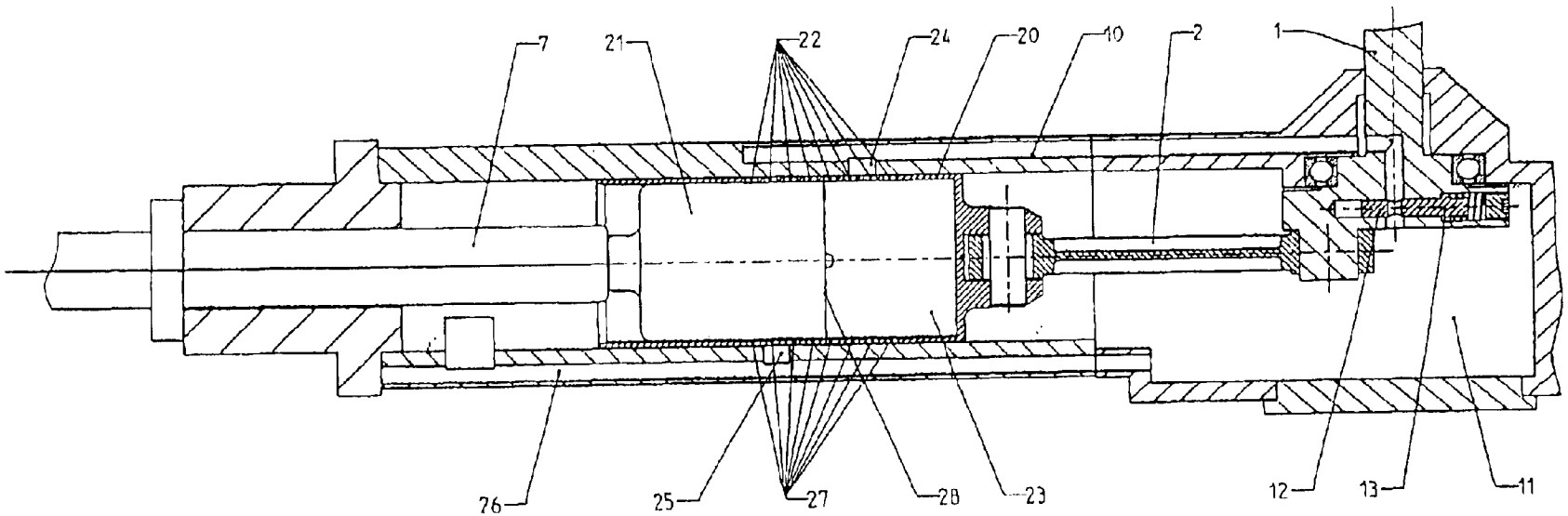
FIG. 3 shows a pneumatic spring hammer mechanism according to the present invention, realized as a "hollow-piston hammer mechanism"
Figure 4:
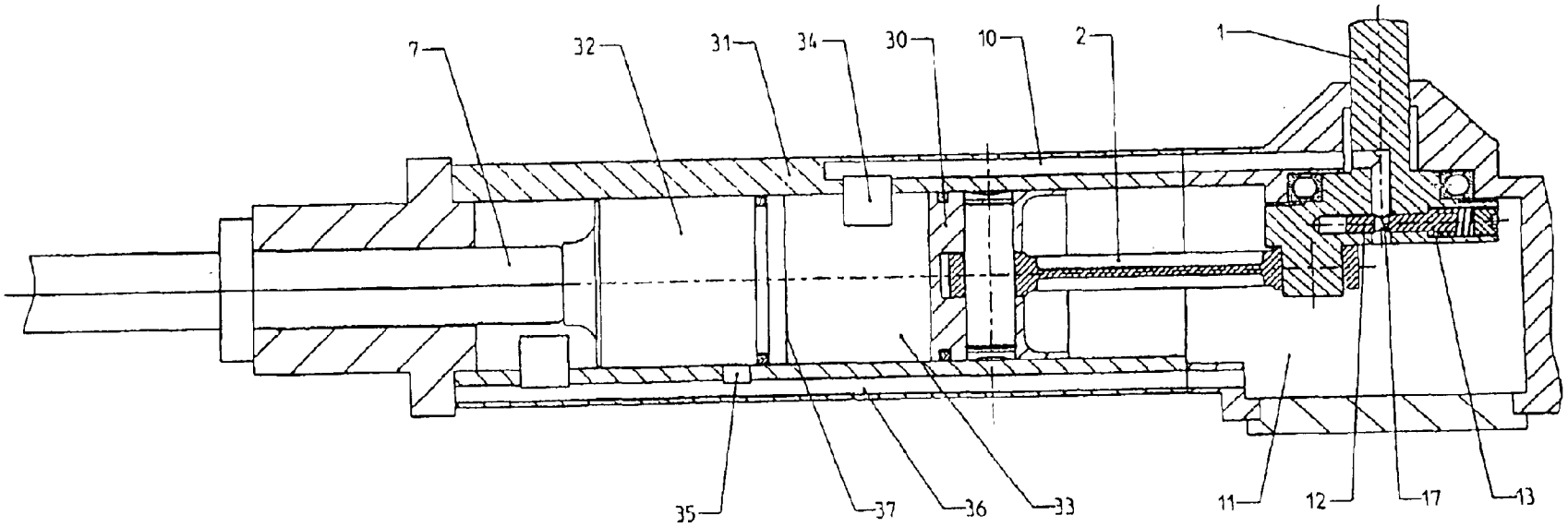
FIG. 4 shows a pneumatic spring hammer mechanism according to the present invention, realized as a "tube hammer mechanism"

FIGS. 3 and 4 show other constructive designs for pneumatic spring hammer mechanisms according to the present invention, in which the manner of functioning of valve 12 and centrifugal weight 13, dependent on the rotational speed of the crankshaft, is comparable with the pneumatic spring hammer mechanism according to FIGS. 1 and 2. Therefore, only the essential differences are explained.

FIG. 3 shows, in schematic section, a pneumatic spring hammer mechanism according to the present invention, also designated a hollow-piston hammer mechanism, in which a drive piston 20 having a hollow construction is moved back and forth by connecting rod 2.

In the interior of the hollow space of drive piston 20, a massive percussion piston 21 can likewise be moved back and forth axially.

In the cylindrical side wall of drive piston 20, a plurality of idling openings 22 are provided via which a hollow space 23 formed between drive piston 20 and percussion piston 21 can be connected with an opening 24 and with channel 10.

Channel 10 leads to crank chamber 11, which acts as a compensating chamber; valve 12 with centrifugal weight 13 is switched between these in the manner described above.

Idling openings 22 are situated axially to one another, so that a constant connection between hollow space 23 and opening 24 is ensured in every axial position of drive piston 20.

In addition, an opening 25 is provided that leads to an additional channel 26, which likewise stands in communicating connection with crank chamber 11. Opening 25 can pass over into idling openings 27 provided in drive piston 20.

In this way, an additional idling device is realized with which, independently of the above-described idling device that is dependent on the crankshaft rotational speed, hollow space 23 can be brought into communicating connection with crank chamber 11 when percussion piston 21 moves into its furthest forward axial position (not shown in FIG. 3). This axial position, also designated the idling position, is possible whenever the operator lifts the chisel from the stone to be processed, so that shaft 7 slides out of the housing of the hammer somewhat. A rear edge 28 of percussion piston 21 then passes over opening 25, and clears a connection between hollow space 23 and opening 25. In this case, hollow space 23 is brought into communicating connection with crank chamber 11, so that no air spring can build up in hollow space 23. This idling device enables an idling operating state to be achieved independently of the movement-frequency-dependent idling operation or of the rotational speed of crankshaft 1, and is thus a supplementary feature.

FIG. 4 shows a variant, also designated a tube hammer mechanism, of the pneumatic spring hammer mechanism according to the present invention.

A drive piston 30, driven by crankshaft 1 and connecting rod 2, can be moved back and forth axially in a housing part that is also designated hammer mechanism tube 31.

In the same hammer mechanism tube 31, a massive percussion piston 32, having essentially the same diameter as drive piston 30, is likewise situated so as to be capable of axial movement.

Between drive piston 30 and percussion piston 32, a hollow space 33 is formed that accommodates an air spring for driving percussion piston 32. Via an opening 34 and channel 10, hollow space 33 can be brought into communicating connection with crank chamber 11; at the end of channel 10, valve 12 with centrifugal weight 13 is situated in the manner described above.

Here as well, the communicating connection between hollow space 33 and crank chamber 11 can be controlled dependent on the rotational speed of crankshaft 1.

In addition, an opening 35 that leads to an additional channel 36 and thus to crank chamber 11 is provided as an additional idling device.

As has already been described in connection with FIG. 3, this additional idling device makes it possible for the hammer mechanism to move into an idling operating state even when percussion piston 32 has reached its furthest forward position (not shown in FIG. 4) after the lifting of the chisel from the stone to be processed and the corresponding sliding of shaft 7 out of the housing. In this case, a rear edge 37 of percussion piston 32 slides over opening 35 and clears a connection between hollow space 33 and channel 36.

The additional idling device has the consequence that the hammer mechanism can also move into the idling operating state independently of the rotational speed of the motor or of the crankshaft.

After the tool has been placed again onto the stone to be processed, and shaft 7 has correspondingly moved into the interior of the housing, percussion piston 32 is pushed into the position shown in FIG. 4, whereby the connection between hollow space 33 and channel 36 or crank chamber 11 is closed. As long as crankshaft 1 is at operating rotational speed, and, correspondingly, opening 17 on valve 12 is closed, percussive operation can begin again.

Figure 5:
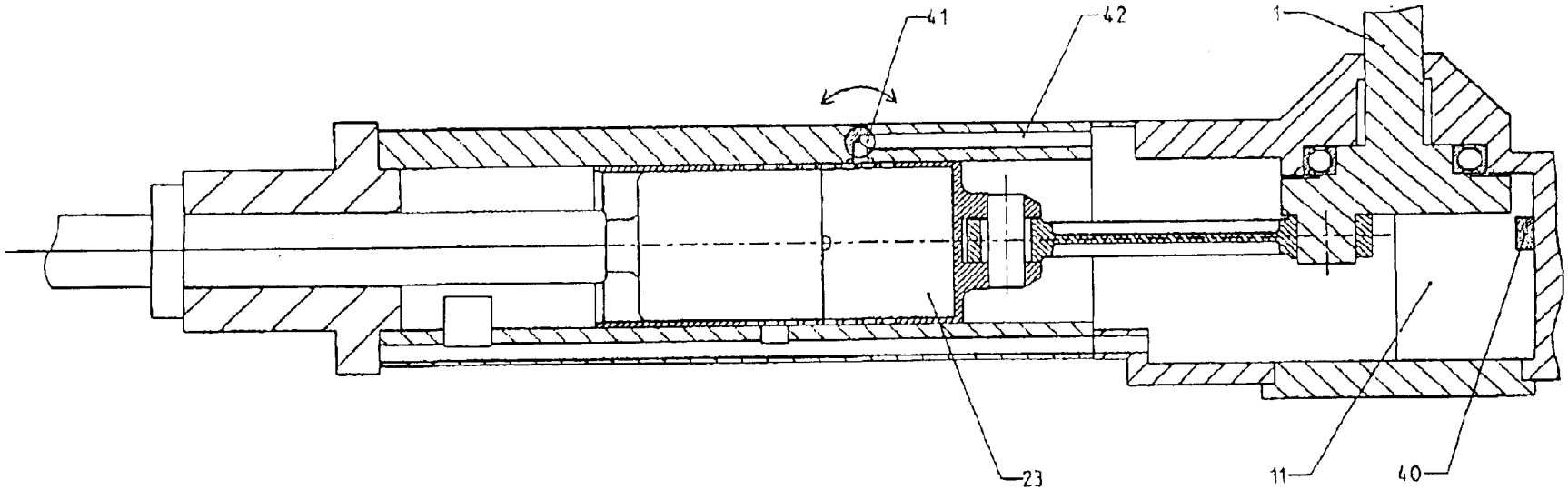
FIG. 5 shows a pneumatic spring hammer mechanism according to the present invention, realized as a "hollow-piston hammer mechanism," and having an electronically controlled valve.

FIG. 5 shows a pneumatic spring hammer mechanism that operates according to the same principle as does the pneumatic spring hammer mechanism of FIG. 3. A repeated description of the effective mechanical connections is therefore omitted.

However, in place of valve numeral 12 and centrifugal weight 13, a rotational speed sensor 40 is here situated in the vicinity of crankshaft 1. Rotational speed sensor 40 is used to acquire the rotational speed of crankshaft 1. It can operate according to various known principles, e.g. magnetically, optically, inductively, etc.

Rotational speed sensor 40 supplies a signal to a control unit (not shown) that controls an electromagnetic valve 41, situated in a channel 42 that connects hollow space 23 with crank chamber 11, dependent on the determined rotational speed value. As long as the rotational speed of crankshaft 1 is greater than a predetermined value, valve 41 is closed, and interrupts a connection between hollow space 23 and crankshaft 11. Valve 41 is for example a 2/2-way valve having a valve body that can be pivoted electromagnetically between two positions. If, however, the rotational speed of crankshaft 1 is less than the predetermined value, the control unit opens valve 41, so that a communicating connection between hollow space 23 and crank chamber 11 results via channel 42.

The electronic solution shown in FIG. 5 has, in relation to the mechanical solution shown in connection with FIGS. 1 to 4, the advantage that the "dead spaces," i.e., the space present between hollow spaces 6, 23, and 33 and valve 12, 41, are smaller due to the smaller spacing. This enables a better suctioning back in percussive operation.

In all the specific embodiments of the present invention presented here, it has been specified that the hollow space between the drive piston and the percussion piston is to be brought into connection with the crank chamber, which acts as a compensating chamber. As an alternative to this, it is also possible for other hollow spaces that guarantee a certain freedom from dust and therefore a certain cleanness to act as a compensating chamber in a percussive hammer and/or drill hammer. In principle, it would also the possible to bring the hollow space into connection with the area surrounding the percussive hammer and/or drill hammer. However, in this case it would be necessary to use an air filter to ensure that no dirt can penetrate into the hollow space.

Besides the already-described mechanical and electromagnetic valves 12, 41, other known valve types, such as for example piezovalves, can be used.

In the above specification, it is assumed that the rotational speed of crankshaft 1 is identical with the rotational speed of the internal-combustion engine. Of course, variants are also possible in which a gear mechanism is connected between the motor and crankshaft 1 in order to convert the rotational speed. Here, the predetermined rotational speed value of crankshaft 1, used as a boundary value for the opening and closing of the valve, is usefully adapted correspondingly to the idling rotational speed of the internal-combustion engine.

Instead of the determination of the crankshaft rotational speed by the sensor device, it is also possible to acquire the frequency of movement of the drive piston directly, for example via a proximity sensor, or also to acquire the movement of connecting rod 2. In addition, there are numerous possibilities for determining the frequency of movement of the drive piston on the basis of the rotational speed of the drive motor, its ignition frequency, or, in the case of an electric motor, the electrical drive frequency or its power consumption.

What is claimed is:

1. A pneumatic spring hammer mechanism for one of a percussive hammer and a drill hammer, comprising;

a drive piston that is moved back and forth by a drive mechanism;

a percussion piston that is moved back and forth and that is situated coaxially to the drive piston;

a hollow space, formed between the drive piston and the percussion piston, for accommodating an air spring in a percussive operation of the pneumatic spring hammer mechanism;

an idling air channel via which the hollow space can be connected with compensating chamber; and a valve situated in the idling air channel, wherein open and closed positions of the valve depend on a frequency of movement of the drive piston.

2. A pneumatic spring hammer mechanism a recited in claim 1, wherein the valve is opened when the frequency of movement of the drive piston falls below a predetermined value, so that a communicating connection arises, via the idling air channel, between the hollow space and the compensating chamber, thereby placing the pneumatic spring hammer mechanism in an idling operating state.

3. A pneumatic spring hammer mechanism as recited in claim 2, further comprising a crankshaft that drives the drive piston, wherein the crankshaft is driven by an internal-combustion engine.

4. A pneumatic spring hammer mechanism as recited in claim 3, wherein the predetermined frequency of movement of the drive piston essentially corresponds to an idling rotational speed of the internal-combustion engine.

5. A pneumatic spring hammer mechanism a recited in claim 1, wherein the frequency of movement of the drive piston is acquired by a sensor device.

6. A pneumatic spring hammer mechanism as recited in claim 1, wherein the compensating chamber is one of a crank chamber allocated to the crankshaft and an area surrounding the pneumatic spring hammer mechanism.

7. A pneumatic spring hammer mechanism a recited in claim 1, wherein an additional idling device is provided with which, independent of the frequency of movement of the drive piston, the hollow space is brought into communicating connection with one of the compensating chamber and another compensating chamber when the percussion piston moves into a forward axial position, and wherein the connecting communication is effected through the sliding of a tool out of a housing of the pneumatic spring hammer mechanism, thereby placing the pneumatic spring hammer mechanism in an idling state independently of the frequency of movement of the drive piston.

8. A pneumatic spring hammer mechanism as recited in claim 7, wherein the additional idling device has at least one idling opening that penetrates a side wall of the drive piston or of the percussion piston.

9. A pneumatic spring hammer mechanism as recited in claim 1, wherein the percussion piston has at least one hollow area in which the drive piston is accommodated so as to be capable of axial movement.

10. A pneumatic spring hammer mechanism as recited in claim 1, wherein the drive piston has at least one hollow area in which the percussion piston is accommodated so as to be capable of axial movement.

11. A pneumatic spring hammer mechanism as recited in claim 1, wherein a hammer mechanism tube is provided in which the percussion piston and the drive piston are guided so as to be capable of axial movement.

12. A pneumatic spring hammer mechanism a recited in claim 1, wherein the open and closed positions of the valve depend only on the frequency of movement of the drive piston.

13. A pneumatic spring hammer mechanism for one of a percussive hammer and a drill hammer, comprising;

a drive piston that is moved back and forth by a drive mechanism;

a percussion piston that is moved back and forth and that is situated coaxially to the drive piston;

a hollow space, formed between the drive piston and the percussion piston, for accommodating an air spring in a percussive operation of the pneumatic spring hammer mechanism;

an idling air channel via which the hollow space can be connected with a compensating chamber; and a valve situated in the idling air channel, wherein open and closed positions of the valve depend on a frequency of movement of the drive piston, wherein the frequency of movement of the drive piston is acquired by a sensor device on the basis of the operating condition of at least one element other than the drive shaft, namely a rotational speed of one of a wobble shaft and a crankshaft of a drive mechanism that drives the drive piston;

a rotational speed of a drive motor that drives the drive mechanism;

an ignition frequency of an internal-combustion engine that acts as the drive motor; and a power consumption of an electric motor that acts as a drive motor.

14. A pneumatic spring hammer mechanism for one of a percussive hammer and a drill hammer, comprising;

a drive piston that is moved back and forth by a drive mechanism;

a percussion piston that is moved back and forth and that is situated coaxially to the drive piston;

a hollow space, formed between the drive piston and the percussion piston, for accommodating air spring in a percussive of operation of the pneumatic spring hammer mechanism;

an idling air channel via which the hollow space can be connected with a compensating chamber; and a valve situated in the idling air channel, wherein open and closed positions of the valve depend on a frequency of movement of the drive piston, wherein the valve is opened and closed depending on a signal of a rotational speed sensor that acquires the rotational speed of a crankshaft of a drive mechanism that drives the drive piston.

15. A pneumatic spring hammer mechanism as recited in claim 14, wherein the valve is controlled via a movable centrifugal weight that is situated on the crankshaft.

16. A pneumatic spring hammer mechanism as recited in claim 15, wherein the valve is opened and closed dependent on a position of the centrifugal weight.

17. A pneumatic spring hammer mechanism for one of a percussive hammer and a drill hammer, comprising a housing;

a drive piston;

a drive mechanism that drives the drive piston back and forth relative to the housing;

a percussion piston that is situated coaxially with the drive piston, a hollow space being formed between the drive piston and the percussion piston, the hollow space acting as an air spring during percussive operation, wherein the air spring drives the percussion piston back and forth by transmitting the force of the drive piston to the percussion piston, a compensating air chamber is located in the housing, and an idling air channel is located in the housing, the idling chamber connecting the hollow space to the compensating air chamber; and a valve that is situated inside the idling air channel, the valve opening and closing depending on the frequency of movement of the drive piston.

18. A pneumatic spring hammer mechanism as recited in claim 17, wherein the open and closed position of the valve depends only on the frequency of movement of the drive piston.

19. A pneumatic spring hammer mechanism as recited in claim 17, wherein the valve is normally closed and opens whenever the drive piston movement drops below a predetermined frequency.

20. A pneumatic spring hammer mechanism for one of a percussive hammer and a drill hammer, comprising;

a drive piston that is moved back and forth by a drive mechanism;

a percussion piston that is moved back and forth and that is situated coaxially to the drive piston;

a hollow space, formed between the drive piston and the percussion piston, for accommodating an air spring in a percussive operation of the pneumatic spring hammer mechanism;

an idling air channel via which the hollow space can be connected with compensating chamber; and a means for opening and closing the idling air channel dependent on a frequency of movement of the drive piston.

* * * * *